US010379456B2

(12) United States Patent
Borenstain et al.

(10) Patent No.: US 10,379,456 B2
(45) Date of Patent: Aug. 13, 2019

(54) CHARGE ROLLER POSITIONING

(71) Applicant: HP Indigo, B.V., Amstelveen (NL)

(72) Inventors: Shmuel Borenstain, Ness Ziona (IL); Ami Halfon, Ness Ziona (IL); Henryk Birecki, Palo Alto, CA (US); Seongsik Chang, Palo Alto, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/173,890

(22) Filed: Oct. 29, 2018

(65) Prior Publication Data

US 2019/0064691 A1 Feb. 28, 2019

Related U.S. Application Data

(63) Continuation of application No. 14/545,967, filed as application No. PCT/US2015/027657 on Apr. 24, 2015, now Pat. No. 10,114,308.

(51) Int. Cl.

| | |
|---|---|
| ***G03G 15/00*** | (2006.01) |
| ***G03G 15/02*** | (2006.01) |
| ***G03G 15/10*** | (2006.01) |
| ***G03G 15/16*** | (2006.01) |
| *G03G 21/00* | (2006.01) |

(52) U.S. Cl.

CPC ..... *G03G 15/0233* (2013.01); *G03G 15/025* (2013.01); *G03G 15/105* (2013.01); *G03G 15/1645* (2013.01); *G03G 15/50* (2013.01); *G03G 15/5037* (2013.01); *G03G 15/10* (2013.01); *G03G 21/0076* (2013.01)

(58) Field of Classification Search

CPC .... G03G 15/25; G03G 15/105; G03G 15/233; G03G 15/1645; G03G 21/76; G03G 21/1647; G03G 2221/1654; G03G 2215/957

USPC ... 399/38, 50, 107, 110, 115, 130, 168, 174, 399/176

See application file for complete search history.

(56) References Cited

U.S. PATENT DOCUMENTS

| | | | | |
|---|---|---|---|---|
| 5,602,712 A | | 2/1997 | Daifuku et al. | |
| 5,897,238 A | * | 4/1999 | Hockey ..... | G03G 15/0291 250/324 |

(Continued)

FOREIGN PATENT DOCUMENTS

| | | |
|---|---|---|
| JP | 2014010252 | 1/2014 |
| WO | WO-2014120155 | 8/2014 |

OTHER PUBLICATIONS

International Preliminary Report on Patentability dated Nov. 2, 2017, PCT Patent Application No. PCT/US2015/027657, filed Apr. 24, 2015, The International Bureau of WIPO, 11 pages.

(Continued)

*Primary Examiner* — Hoan H Tran

(74) *Attorney, Agent, or Firm* — Wall &Tong LLP

(57) ABSTRACT

In one example, a method for calibrating a position of a charge roller is described. The method may include a processor positioning a first end of a charge roller to a first plurality of index positions, determining a capacitance between the charge roller and a photoconductor imaging plate at each of the first plurality of index positions, determining a first index position of the first plurality of index positions with a greatest change in capacitance, and calibrating a position of the charge roller based upon the first index position.

20 Claims, 10 Drawing Sheets

(56) References Cited

U.S. PATENT DOCUMENTS

| | | | | |
|---|---|---|---|---|
| 6,332,064 | B1 * | 12/2001 | Sato | G03G 15/0216 399/128 |
| 6,493,523 | B2 | 12/2002 | Weaver | |
| 7,366,447 | B2 | 4/2008 | Mukai et al. | |
| 7,583,914 | B2 | 9/2009 | Hatakeyama | |
| 7,596,330 | B2 | 9/2009 | Oron | |
| 8,705,990 | B2 | 4/2014 | Pines et al. | |
| 8,731,436 | B2 | 5/2014 | Gamzon-Kapeller et al. | |
| 9,069,312 | B2 * | 6/2015 | Kanai | G03G 15/50 |
| 9,075,334 | B2 * | 7/2015 | Araki | G03G 15/0266 |
| 2008/0267646 | A1 | 10/2008 | Oron et al. | |
| 2010/0288146 | A1 | 11/2010 | Levanon et al. | |
| 2012/0019965 | A1 | 1/2012 | Faxvog et al. | |
| 2012/0308262 | A1 | 12/2012 | Gamzon-Kapeller et al. | |
| 2013/0343771 | A1 | 12/2013 | Pines et al. | |

OTHER PUBLICATIONS

International Search Report and Written Opinion dated Jan. 22, 2016, PCT Patent Application No. PCT/US2015/027657, filed Apr. 24, 2015, Korean Intellectual Property Office, 14 pages.

* cited by examiner

200

400

500

1000

CHARGE ROLLER POSITIONING

PRIORITY

This application is a Continuation of commonly assigned and co-pending U.S. patent application Ser. No. 15/545,967, filed Jul. 24, 2017, which is a national stage filing under 35 U.S.C. § 371 of PCT Application Number PCT/US2015/027657, having an international filing date of Apr. 24, 2015, the disclosures of which are hereby incorporated by reference in their entireties.

BACKGROUND

Digital printing technologies rely on the adhesion of printing fluid particles to a substrate to produce a printed item. For example, a liquid electro-photography (LEP) press or a dry toner electro-photography (DEP) press may provide for the controlled movement of colorant material, such as toner particles, under the influence of an electric field to create images, such as text, graphics, or pictures, on media.

DETAILED DESCRIPTION

Figure 1:
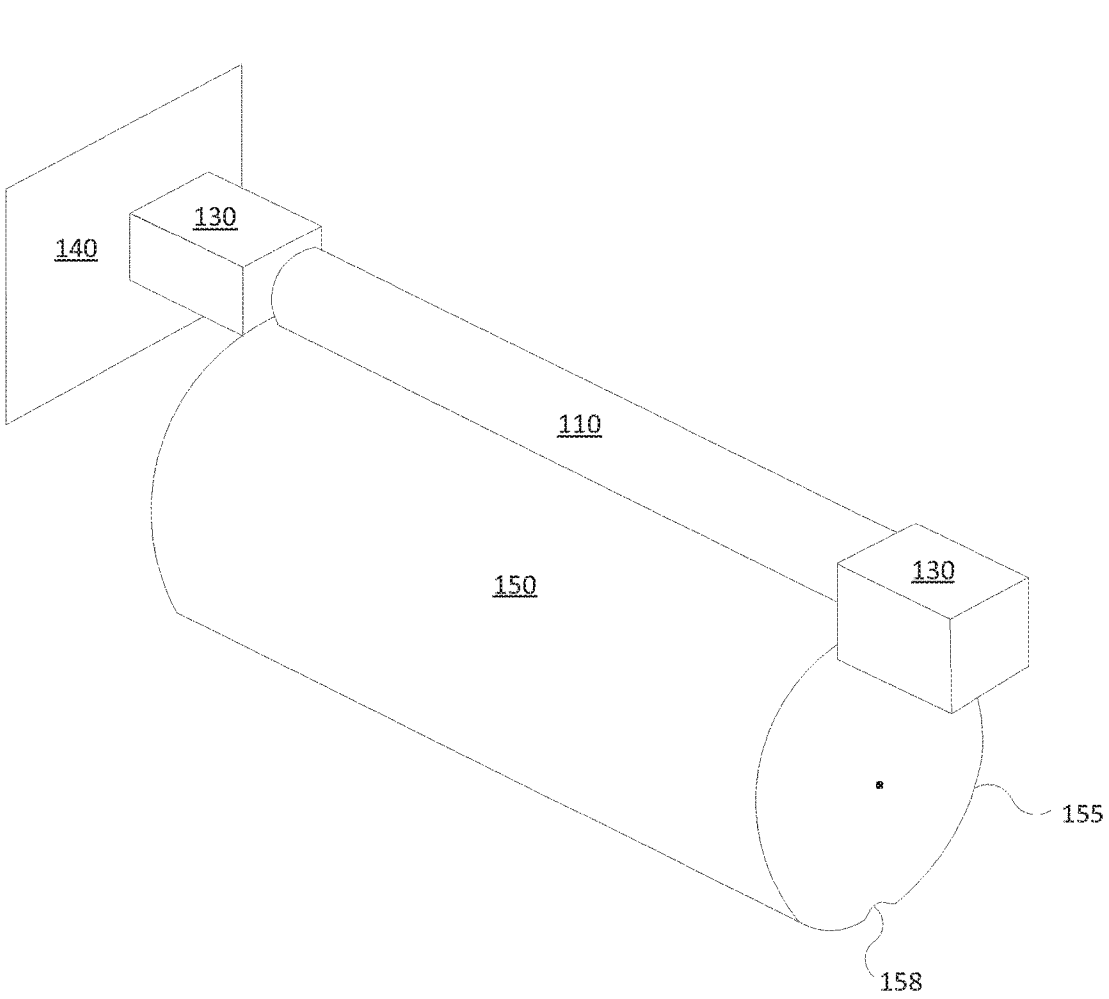
FIG. 1 is a perspective view of an example system of the present disclosure.

In one example, the present disclosure describes a device, method, and non-transitory computer-readable medium for calibrating a position of a charge roller. For example, a processor may position a first end of a charge roller to a first plurality of index positions, determine a capacitance between the charge roller and a photoconductor at each of the first plurality of index positions, determine a first index position of the first plurality of index positions with a greatest change in capacitance, and calibrate a position of the charge roller based upon the first index position.

In another example, the present disclosure describes a device, method, and non-transitory computer-readable medium for adjusting a position of a charge roller. For example, a processor may measure an alternating current in a printing device, where the printing device comprises a charge roller and a photoconductor. The processor may then determine a capacitance between the charge roller and the photoconductor, where the capacitance is determined based upon a measurement of the alternating current, calculate a distance between the charge roller and the photoconductor based upon the capacitance, and adjust a position of the charge roller when the distance is greater than a first threshold distance or when the distance is less than a second threshold distance.

In another example, the present disclosure describes a device that may include a charge roller, a photoconductor, at least one positioning unit for positioning at least a first end of the charge roller to a first plurality of index positions, and a current sensor, for measuring an alternating current in a circuit comprising the charge roller and the photoconductor when the at least the first end of the charge roller is at each of the first plurality of index positions. The printing device may further include a controller for determining a first index position of the first plurality of index positions with a greatest change in capacitance and calibrating a position of the charge roller based upon the first index position.

In electro-photographic printing devices, a photoconductor imaging plate (PIP) may include a photoconductor layer, and may be supported by a PIP member, e.g., a cylinder or drum. In one example, the PIP is charged to a high potential, e.g., 1000 volts or more, using a charging unit. As the PIP member rotates, portions of the photoconductor layer of the PIP pass the charging unit. A laser unit with one or more lasers then selectively discharges portions of the photoconductor layer, such that the photoconductor layer includes charged areas and non-charged areas. A printing material, such as ink, toner, or the like, is then transferred to the PIP and adheres to the areas where the photoconductor layer has been discharged by the laser unit. As the PIP member continues to rotate, the photoconductor layer is then discharged by a light source prior to the printing material being transferred from the PIP to a substrate or to an intermediate transfer member (ITM), e.g., a drum, a cylinder, a blanket, and so forth.

Various electro-photographic printing devices utilize a charge roller as the charging unit. A charge roller may comprise a contact charge roller, e.g., formed of a conductive rubber material, or may be formed of a conductive ceramic material, also referred to a permanent charge roller (PCR) because of its long lifespan, for example. In the case of a contact charger roller, during printing operations the charge roller may be in contact with the PIP. In one example, the PIP comprises a foil, where the PIP member includes a seam where the PIP can be inserted and locked. In one example, the radius of the PIP member is smaller in the seam area than for the remainder of the PIP member, and may lead to residue in the seam area. Therefore, a jump-over-seam (JOS) operation may be performed each time a seam of the PIP member rotates into the area where the charge roller and the PIP are in contact. In contrast, a permanent charge roller may operate with an air gap between the charge roller and the PIP. In both cases, however, a leveling procedure may be used to bring the charge roller into a horizontally parallel position with respect to the PIP, and with respect to the PIP member. For example, a charge roller may be connected to two positioning units, one at each end of the charge roller, for leveling the charge roller. In the case of the contact charge roller, the positioning units may also be used to perform the JOS operation.

In one example, a calibration position for the charge roller is found by performing capacitance measurements between the charge roller and the PIP as the ends of the charge roller are moved through a range of index positions by the positioning units. In one example, alternating current (AC) measurements in a circuit comprising the charge roller and PIP are used as a proxy for the capacitance, due to the proportionality between capacitance and the current. The calibration position may be determined to be the pair of index positions where the maximum of the derivative of the capacitance (and/or the measured AC current, as a proxy for the capacitance) is observed for each end of the charge roller. For example, the maximum of the derivative of the capacitance may occur at the position where the end of charge roller starts in contact with the surface of the PIP member. From the calibration position, the charge roller may then be adjusted into a position for operation, based upon an offset from the calibration position. The calibration position may also be used to calibrate a jump position for a JOS operation, in the case where the charge roller is a contact charge roller.

In another example, the present disclosure may also verify a distance between the charge roller and the PIP in an operating position during operations, and adjust the position if the distance is outside a target distance window. The operating position may comprise a floating position of a permanent charge roller, or a jump position for JOS operations with respect to a contact charge roller. In one example, the charge roller and the PIP may be modeled as a capacitor, where the capacitance is inversely proportional to a separation distance between charge roller and the PIP. In one example, the capacitance is modeled as a cylinder over an infinite plane and provides for the accurate calculation of the separation distance. An alternating current in the circuit comprising the charge roller and the PIP may be measured in a similar manner to the above example. A voltage of a power supply may be known, and from these quantities, the capacitance may be determined. Then, using the capacitance model and the capacitance that has been calculated, the separation distance may be determined. Where the distance drifts outside the target distance window, the position of the charge roller may be adjusted. These and other aspects of the present disclosure are described in greater detail below in connection with the example FIGS. 1-9.

FIG. 1 illustrates an example printing device, or system 100 of the present disclosure, e.g., for liquid electro-photography (LEP) or dry toner electro-photography (EP). In one example, the system 100 includes a charge roller 110 and a photoconductor imaging plate (PIP) member 150. In one example, the PIP member 150 may include a photoconductor imaging plate (PIP) 155. For example, the PIP 155 may comprise a foil with a photoconductor layer, a conductive layer, such as aluminum, and an insulating backing layer, such as polyethylene terephthalate (PET) or bi-axially oriented PET (BOPET). The PIP member 150 may also include a support, such as a cylinder or drum, for mounting the PIP 155. In one example, PIP member 150 includes a seam area 158. In various examples, the charge roller 110 comprises a conductive rubber material, a conductive ceramic material, or other conductive material. In one example, the charge roller 110 may be shaped as an elongated cylinder. System 100 also includes positioning units 130 for controlling the positions of the ends of charge roller 110 relative to the PIP member 150. It should be noted that each of the positioning units 130 may be coupled to a respective support. However, for clarity and ease of illustration, a single support 140 is depicted in FIG. 1.

The system 100 may include other components that are omitted from FIG. 1 for clarity, such as: a an intermediate transfer member (ITM), an impression member (e.g., an impression cylinder), a laser unit, a plurality of developers, a heating unit, a raster image processor, a pre-transfer erase (PTE) unit, a cleaning station, a power supply or voltage source, a controller, current and voltage measuring units, a paper tray, a pickup roller, one or more motors, drive rollers, and so forth. Thus, FIG. 1 represents a simplified illustration of the system 100.

Figure 2:
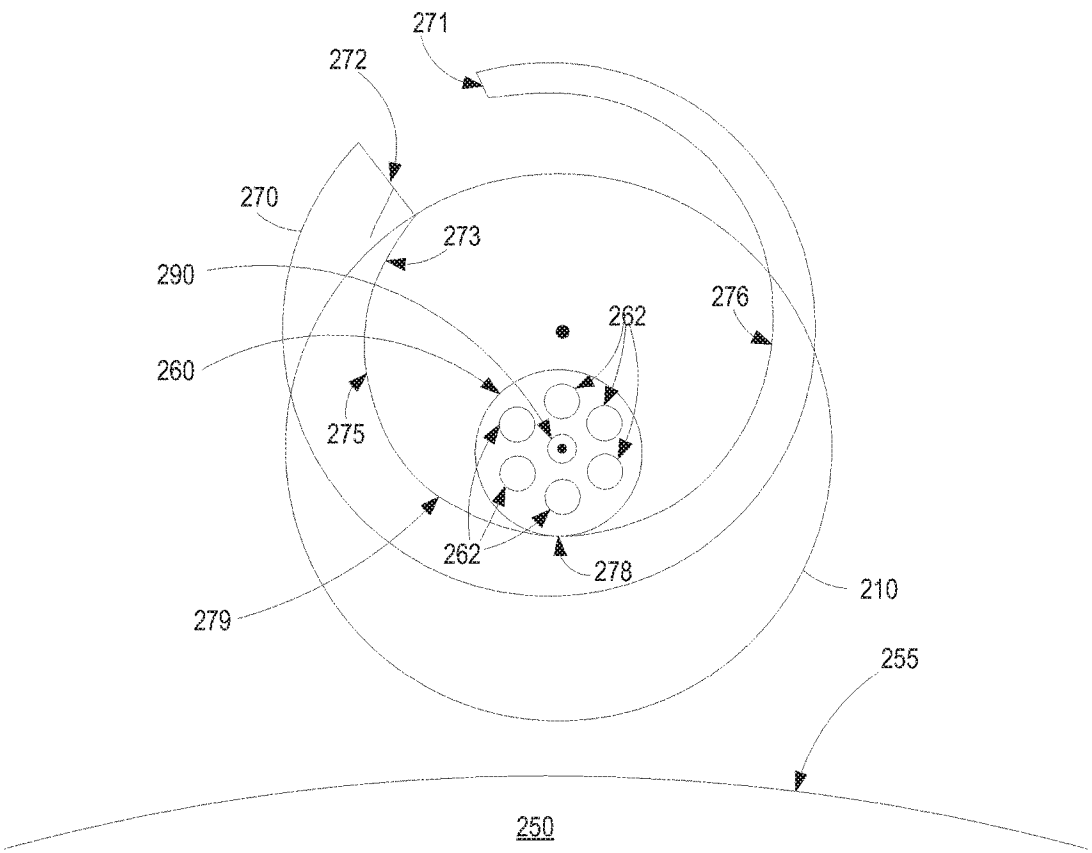
FIG. 2 is a front view of an example system of the present disclosure.
Figure 3:
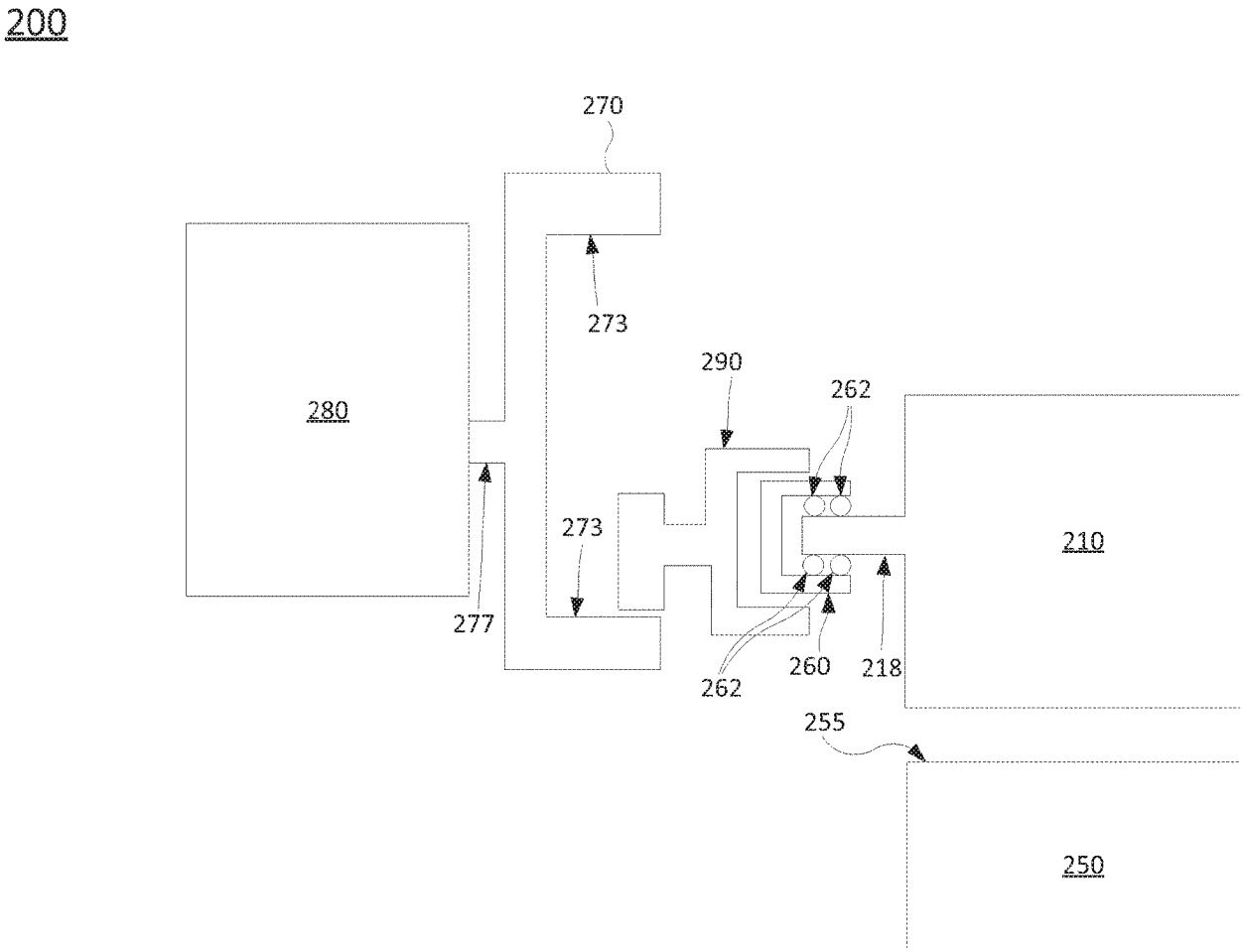
FIG. 3 is a side plan view of an example system of the present disclosure.

FIG. 2 is a front plan view and FIG. 3 is a side plan view, respectively, that illustrates an example system 200, e.g., a charge roller assembly. As shown in FIGS. 2-3, system 200 may include a charge roller 210, a motor 280, e.g., a rotation drive, and a cam 270. In one example, the cam 270 is of variable thickness. For instance, FIG. 2 illustrates a thickness at a first end 271 that is thinner than a thickness at a second end 272 (exaggerated for illustrative purposes). In addition, the thickness of cam 270 tapers along curve 273 between the first end 271 and second end 272. In one example, system 200 includes a charge roller (CR) holder 290 for coupling the charge roller 210 to the cam 270. In one example, an end cap 260 with bearings 262 is fitted over shaft 218 of charge roller 210 and fitted within the CR holder 290. The bearings 262 allow charge roller 210 to rotate about an axis aligned with the shaft 218, a center of the end cap 260, and a center of CR holder 290.

In one example, the motor 280 and cam 270 may be referred to as a positioning unit. In one example, the motor 280, cam 270, and CR holder 290 may be referred to as a positioning unit. The system 200 may be used, for example, to set the position of an end of the charge roller 210 relative to a PIP member 250 and/or a PIP 255 during an initial calibration, as an adjustment during printing operations, or to alter and restore the position of the end of the charge roller during a jump-over-seam operation. It should be noted that system 200 may include a positioning unit at each end of the charge roller 210. However, only one end of charge roller 210 is shown in FIGS. 2 and 3.

As illustrated in FIGS. 2 and 3, cam 270 may be coupled to and supported by motor 280, which may cause and control rotational movement of cam 270. For example, motor 280 may control a direction of rotation of drive shaft 277 and a speed of rotation of drive shaft 277, as well as control the initiation and termination of rotation of drive shaft 277. In one aspect, motor 280 is a discrete increment drive, which rotates one increment at a time in order to provide precise and accurate control over movement of drive shaft 277. In one example, motor 280 comprises a rotational actuator. In one example, each rotational increment of motor 280 may produces a corresponding rotational movement of the contour 273 of cam 270, thereby changing the position along contour 273 upon which the CR holder 290 rests. Since shaft 218 of charge roller 210 is connected to CR holder 290 via the end cap 260, a rotation of cam 270 also results in a change in position of charge roller 210 with respect to PIP member 250 and/or PIP 255. Accordingly, cam 270 provides for accurate control of the spacing of charge roller 210 relative to a seam region of PIP member 250.

In one example, a first target point 275 corresponds to a jump-over-seam position of the end of the charge roller 210, where charge roller 210 comprises a contact charge roller. For instance, first target point 275 may set a first end of a range of rotation of cam 270 during printing operations. Further calibration of system 200 may identify a second target point 276 may set a second end of a range of rotation of cam 270 corresponding with charge roller 210 rolling on a non-seam region of PIP member 250 with a target nip height between charge roller 210 and PIP 255. During printing operations, cam 270 may rotate such that a contact point between CR holder 290 and cam 270 is moved between the first target point 275 and second target point 276, thereby providing a dynamic limit on the position of charge roller 210 relative to PIP member 250 and/or PIP 255.

For instance, when a seam region of PIP member 250 passes underneath charge roller 210, CR holder 290 may be positioned at the first target point 275 which may cause charge roller 210 to be raised relative to PIP 255 and PIP member 250, such that a greater spacing is caused between a center axis of charge roller 210 (e.g., along shaft 218) and a center axis of PIP member 250. This relationship, in turn, may ensure that an outer surface of charge roller 210 falls within a target position window to maintain proper spacing relative to a seam region of the PIP member 250.

When charge roller 210 resumes contact with PIP 255 in a non-seam region of PIP member 250, CR holder 290 may be in contact with cam 270 at second target point 276, where the contour 273 of cam 270 has a smaller radius than the radius at first target point 275. This relationship results in CR 290 dropping, which in turn causes end cap 260, shaft 290, and charge roller 210 to descend, and thereby engaging PIP 255 at a target nip height. In one example, the dropping and descent are in a vertical direction with respect to ground. Alternatively, or in addition, the dropping and descent may indicate a movement from a central axis of the charge roller 210 toward a central axis of PIP member 250.

In one example, the rotation of cam 270, via motor 280, cycles between clockwise and counterclockwise rotation as cam 270 moves relative to CR holder 290 through the operational range of cam 270 between the first target point 275 and the second target point 276 for a particular charge roller 210. Accordingly, upon CR holder 290 reaching one of the first target point 275 or the second target point 276, motor 280 may reverse the rotational direction of drive shaft 277 to reverse the rotational direction of cam 270. This cycle may be repeated for each revolution of PIP member 250.

In one example, determining an initial calibration position of charge roller 210 includes first letting charge roller 210 rest on PIP member 250 via action of gravitational forces by having motor 280 rotate cam 270 such that CR holder 290 is in contact with the contour 273 of cam 270 at or near the first end 271. This may produce maximum compression (at least due to gravitational forces acting on charge roller 210) of charge roller 210 and the PIP 255.

Next, as part of establishing a calibration position of charge roller 210, motor 280 may be engaged to rotate cam 270 one increment at a time through a range of increments, e.g., until CR holder 290 is in contact with the contour 273 of cam 270 at or near the second end 272. At each increment, the CR holder 290 is raised, causing the charge roller 210 to be raised by one index position. In another example, the charge roller 210 may be first raised by rotating cam 270 such hat CR holder 290 is in contact with the contour 273 at or near the second end 272 and then rotating cam 270 one increment at a time through a range of increments, e.g., until CR holder 290 is in contact with the contour 273 of cam 270 at or near the first end 271, or until the charge roller 210 can be lowered no further due to contact with the PIP 255. At each index position, a capacitance between the charge roller 210 and the PIP 255 may be measured. After a plurality of capacitances for different index positions has been measured, a change in capacitance versus index position is determined for each index position. In one example, the index position where there is the greatest change in capacitance is utilized as part of a calibration position of the charge roller 210. For instance, the index position with a greatest change in capacitance, together with a similar index position determined for another end of the charge roller may comprise the calibration position. To illustrate, point 278 may correspond to an index position of the calibration position with respect to one of the ends of charge roller 210.

Once the index position of the calibration position is determined, one or more operating positions may be determined from the calibration position. For instance, index positions corresponding to first target point 275 and second target point 276 may be determined based upon offsets from an index position corresponding to point 278. In another example, e.g., in the case of a floating and/or permanent charge roller an index position corresponding to point 279 may be determined based upon an offset from the index position corresponding to point 278. For example, point 279 may raise charge roller 210 to a desired separation distance from PIP 255 for printing operations. Thus, the example of FIGS. 2 and 3 may be utilized in connection with printing devices that perform a jump-over-seam (JOS) operation, or for printing devices that use non-contact or floating charge rollers, or that otherwise do not need to perform JOS operations.

It should be noted that the system 200 of FIGS. 2 and 3 includes one example of a positioning unit that is suitable for adjusting the position of a charge roller in accordance with the present disclosure. For instance, in another example, a rotational actuator with a cam and cam follower may be utilized. In another example, a charge roller assembly may utilize a linear actuator as an alternative to a rotational actuator. In still another example, the positioning unit may comprise a non-incremental configuration. In other words, the positioning unit is not limited to moving in discrete increments, but may be capable of a continuous range of motions and a continuous range of positions. Thus, the present disclosure is not limited to the use of any particular type of positioning unit, and FIGS. 2 and 3 are provided for purposes of illustrating one example that can be used to adjust the position of a charge roller end in accordance with the present disclosure. As such, any device or component suitable for use in adjusting and maintaining a position of an end of a charge roller may be utilized in various examples of the present disclosure.

Figure 4:
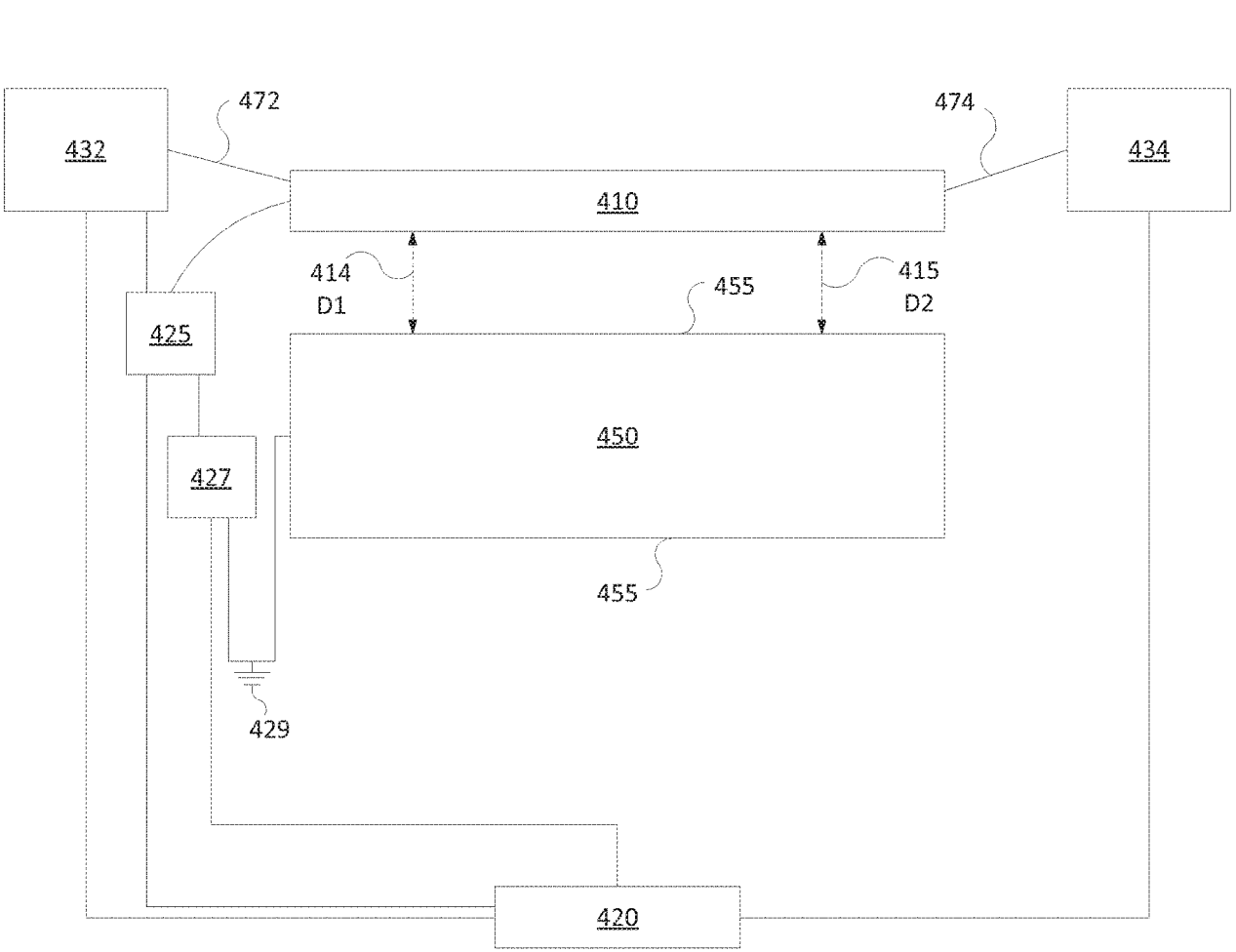
FIG. 4 is a block diagram of an example system of the present disclosure.
Figure 10:
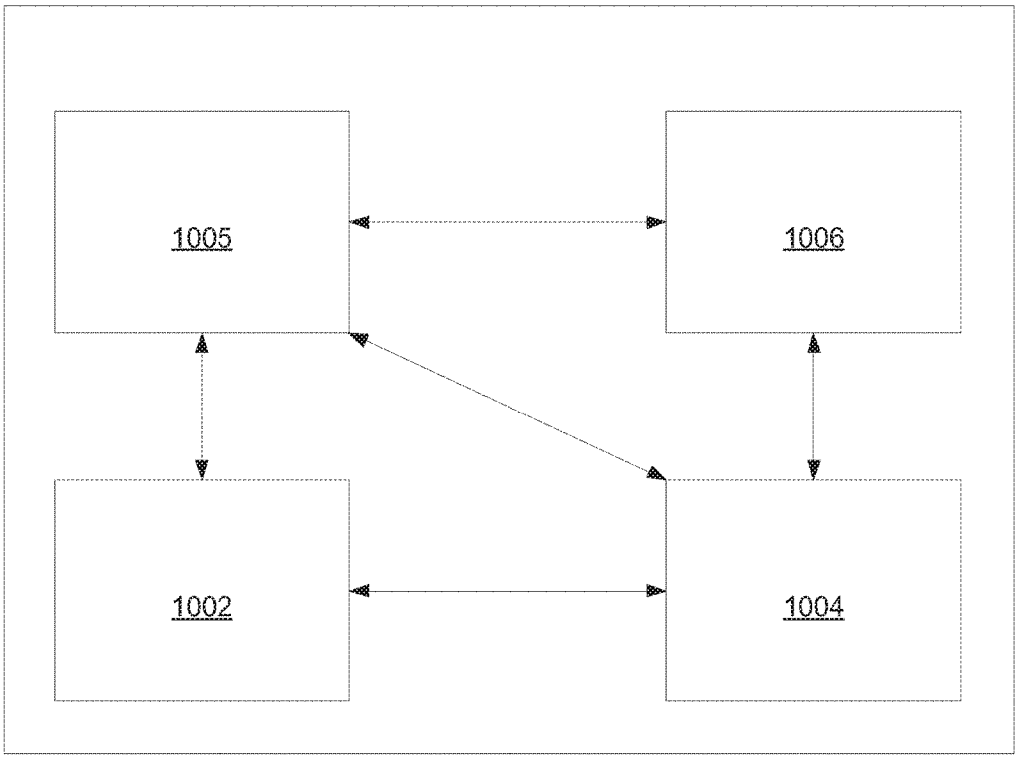
FIG. 10 depicts a high-level block diagram of an example computer that can be transformed into a machine capable of performing the functions described herein.

FIG. 4 illustrates an example system 400 of the present disclosure. In one example, system 400 comprises the same or similar components to those illustrated in system 100 of FIG. 1 and/or system 200 of FIGS. 2 and 3. In one example, system 400 includes charge roller 410, PIP member 450 (including a PIP 455), positioning units 432 and 434 with links 472 and 474 respectively, a controller 420, a current measuring unit 425, and a power supply 427, e.g., a voltage source. In one example, controller 420 may be implemented as a computing device such as illustrated in FIG. 10 and described below, e.g., having a processor, a memory, and so forth.

In one example, power supply 427 charges charge roller 410 during printing operations, e.g., to 1600 volts or greater. In turn, the charge roller 410 may impart a surface charge to PIP 455. In accordance with the present disclosure, power supply 427 may also charge the charge roller 410 to a selected voltage for performing capacitance (or current) measurements, in order to determine a calibration position of the charger roller 410, or to verify an operating position of the charge roller 410. For instance, the power supply 427 may provide an AC voltage to the charge roller 410 according to instructions from controller 420 as part of an algorithm or process for calibrating or adjusting a position of the charge roller 410. In one example, current measuring unit 425 then measures an AC current in a circuit comprising power supply 427, charge roller 410 and PIP member 455. A ground 429 of the circuit is also illustrated in FIG. 4.

To illustrate, a process for calibrating the position of the charge roller 410 may include the controller 420 causing positioning units 432 and 434 to be set to a lowest position, for example, to allow the charge roller 410 to fully rest upon PIP 455 and PIP member 450. The controller 420 may also instruct the power supply 427 to output a particular known AC voltage. The positioning units 432 and 434 may then be instructed by the controller 420 to raise the ends of the charge roller 410, one position at a time. For example, the positioning units 432 and 434 may be driven to move in discrete increments. However, the present disclosure is not limited to positioning units that move in discrete increments. Thus, in another example, the positioning units may move the charge roller in a continuous manner. In any event, the positioning units may move the ends of the charge roller to various positions, which may be referred to as index positions. At each index position, the current measuring unit 425 may measure the AC current. In one example, the positioning units 432 and 434 may take turns raising an end of the charge roller 410 by one index position at a time. In one example, the positioning units 432 and 434 move the charge roller 410 from a lowest index position through to a highest index position (where the positioning unit cannot adjust the index position any higher) under the instructions of controller 420. For instance, positioning unit 432 may raise one end of the charge roller 410 incrementally from an index position resting on PIP 455 all the way to a highest index position. The positioning unit 432 may then lower the end of the charge roller 410 such that it is again resting on PIP 455 and PIP member 450. Positioning unit 434 may then raise the other end of the charge roller 410, incrementally until the highest index position is reached. In another example, the positioning units 432 and 434 may start with one of the ends of the charge roller 410 raised to a maximum index position and then lower the end of the charge roller 410, one position at a time, until the end of the charge roller is fully resting upon the PIP 455 and PIP member 450. In one example, the links 472 and 474 may comprise components of the respective positioning units 432 and 434, e.g., a cam, CR holder, and so forth as illustrated in FIGS. 2 and 3, or components of an alternatively configured positioning unit.

In one example, the charge roller 410 may be allowed to rest upon PIP member 450 with the aid of gravity. However, in another example, the charge roller 410 is not necessarily located above the PIP member 450 in relation to the surface of the Earth. Thus, the terms "raised" and "lowered" as used herein may be relative to a region of the PIP member 450 that the charge roller 410 may contact, where the "lowest" index position is a position in which the charge roller 410 and PIP member 450 are in contact and fully engaged and a "highest" index position corresponding to a limit of one of the positioning units 432 and 434.

In any case, the current measuring unit 425 may take AC current measurements after each adjustment of the positioning units 432 and 434. In one example, the AC current measurements may be used to represent a capacitance between the charge roller 410 and PIP 455. For instance, the capacitance is proportional to the measured current. However, in one example a position at which a maximum rate of change in the capacitance (or measured AC current) occurs is of interest. Thus, in one example, calculating the magnitude of the capacitance for various index positions may be omitted. For instance, the derivative of the measured AC current versus index position may be used in place of the derivative of the capacitance, since the maximum will occur at the same index position with respect to both the derivative of the capacitance and the derivative of the AC current measurement. The maximum of the change in capacitance (and change in measured AC current) occurs at or near the index position in which the charge roller 410 is in contact with the PIP 455. In one example, the out-of-phase components are derived. Thus, in one example, the current measuring unit 425 provides phase sensitive detection (lock-in) of the current to charge roller 410. In one example, this index position is used as at least a portion of the calibration position of the charge roller 410. For example, separate determinations may be made for both ends of the charge roller 410 such that the calibration position may comprise a pair of index positions, one for each end. Thus, charge roller 410 can be placed into an operating position with separation distances D1 414 and D2 415 based upon offsets from the pair of index positions of the calibration position. This aspect of the present disclosure is discussed in greater detail in connection with the example of FIG. 5.

In another example, the charge roller 410 may be placed in an operating position where the charge roller 410 is touching the PIP 455, e.g., for a contact charge roller. For instance, each end of charge roller 410 may be lowered by a particular offset, e.g., by one or more index positions, such that the charge roller 410 is in contact with the PIP 455, e.g., with the weight of the charge roller 410 fully resting on the PIP member 450. In addition, a jump-over-seam (JOS) operation may be configured based upon the calibration position. For instance, in a seam area of the PIP member 450, the charge roller 401 may be raised by the positioning units to a jump position, such that the charge roller 410 is not in contact with the PIP 455. The charge roller 410 may be lowered back into contact with the PIP 455 when the seam area has passed. Thus, in one example, the jump position may comprise a pair of index positions that are determined based upon offsets of a number of index positions from the respective index positions of the calibration position (or based upon offsets from the operating position, which is also based upon the calibration position). For instance, once the charge roller 410 is leveled to a calibration position or an operating position, the jump position may be achieved by equal offsets from the index positions of the calibration position or operating positions.

Although the present disclosure may be used in connection with contact charge rollers, operating a conductive ceramic charge roller, or permanent charge roller (PCR), with an air gap between itself and the PIP has several advantages. For instance, the photoconductor layer is protected from the hard ceramic surface. Unlike conductive rubber charge rollers, it is also possible to have a precise air gap because production run-out tolerances are tighter. A charge roller floating at a fixed gap above the PIP avoids the wear caused by repeatedly performing JOS operations. For example, another leveling technique involves determining a position of the charge roller based upon a detection of electrical discharge at high voltage between the charge roller and the PIP. This technique may be sufficiently accurate for use with a conductive rubber charge roller, but may not be adequate for a conductive ceramic charge roller where more prominent surface features make the separation distance at which electrical discharge occurs inconsistent. Thus, the present disclosure provides a process for determining a precise separation distance that can be used for determining a calibration position for a ceramic charge roller. Moreover, the processes of the present disclosure may also be used in connection with conductive rubber charge rollers, or charge rollers formed of other materials, as an alternative or in addition to other techniques.

In one example, the system 400 may also be utilized to verify a separation distance between charge roller 410 and PIP 455 and to adjust the position of the charge roller 410 when the separation distance indicates that the charge roller 410 is not in a desired position. In one example, the separation distance may be verified while the device is in operation, e.g., while engaged in printing. For instance, after placing the charge roller 410 into an operating position based upon the calibration position, it may be assumed that the charge roller 410 is level with respect to the PIP 455 and PIP member 450. However, the separation distance between charge roller 410 and PIP 455 may drift over time due to various factors such as temperature changes, mechanical deflection of one or more parts of the system 400, and so forth. In this case, a distance between the charge roller 410 and the PIP 455 may be accurately determined by measuring the AC current via current measuring unit 425. The measured AC current may be provided to controller 420, which may then calculate the capacitance, given a known power supply voltage. From the capacitance, the controller 420 may also calculate the separation distance using a capacitance model. For instance, the capacitance model may model the charge roller 410 and PIP 455 as a cylinder over an infinite plane, as discussed in connection with Equation 3 below. If the separation distance drifts outside a target distance window, the position of the charge roller 410 may then be adjusted back to a desired operating position. Similarly, the jump position for a JOS operation may be calibrated, but may also drift over time due to various factors. Thus, the separation distance may be calculated in a similar manner with respect to a jump position to determine that the jump position is maintained correctly over time. In this regard, the jump position may also be considered an "operating position" with respect to verifying and adjusting a separation distance.

Figure 5:
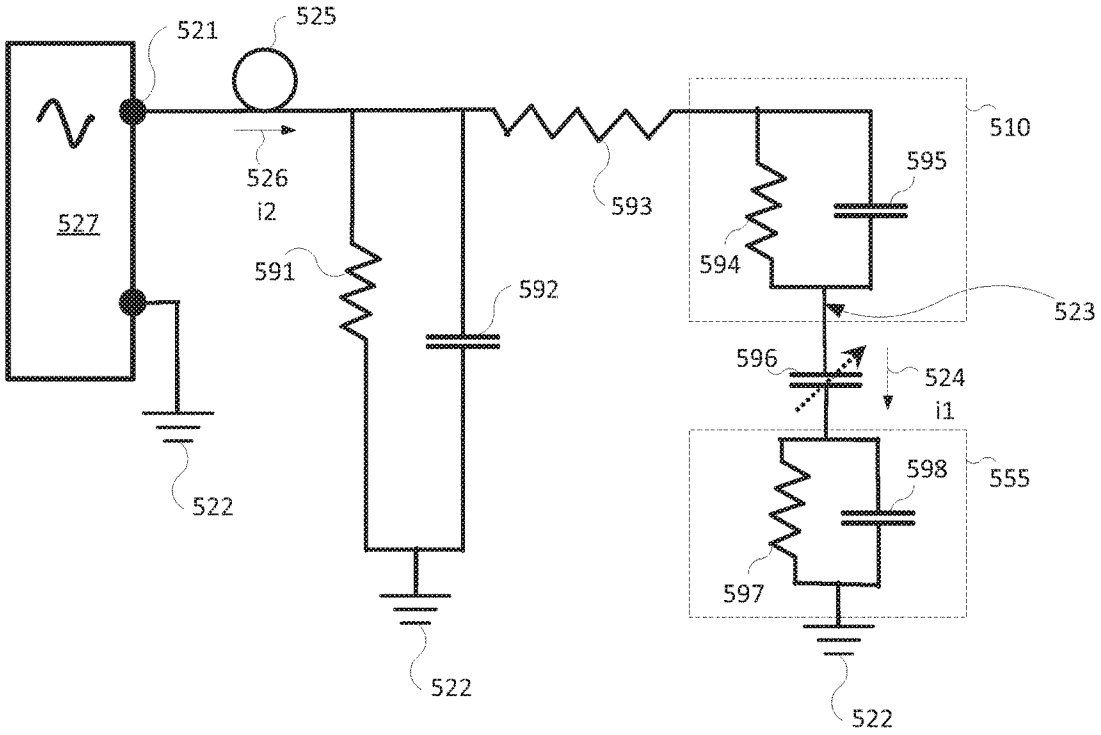
FIG. 5 illustrates a circuit diagram, which may be used as a model of an example system of the present disclosure.

FIG. 5 illustrates a circuit 500 that is representative of portions of the respective systems illustrated in FIGS. 1-4. For example, circuit 500 includes a power supply, or voltage source 527, a charge roller 510, and a PIP 555. Each of these components may represent the same or similar components illustrated in FIGS. 1-4. The charge roller 510 is represented by a resistor 594 and capacitor 595 in parallel. Similarly, the PIP 555 is represented by a resistor 597 and capacitor 550 in parallel. The PIP 555 is illustrated as being connected to a ground 522. The wiring connecting the voltage source 527 to the charge roller 510 is illustrated as a resistor 591 and capacitor 592 in parallel and connected to ground 522, and resistor 593. A gap between the charge roller 510 and PIP 555 is modeled as a tunable capacitor 596. It should be noted that any parameter values provided in the following description are for illustrative purposes. Thus, the present disclosure is not limited to any particular scale or configuration with respect to the components of system 500.

As an example, for purposes of determining a calibration position or for verifying an operating position of charge roller 510, the output voltage 521 of voltage source 527 may be set to a known value, such as 400 volts alternating current (AC) at 9 to 15 kilohertz (KHz). In other words, output voltage 521 comprises a known variable. In one example, resistor 591 has a resistance of greater than 10^9 ohms, and the capacitance of capacitor 592 is approximately 400 to 500 pico-Farads (pF) (measured parasitic). In one example, resistor 593 represents a carbon brush and wires connecting the wiring from the voltage source 527 to the charge roller 510. In one example, the resistance of resistor 593 is less than 100 ohms. In one example, the capacitance of capacitor 595 of the charge roller 510 is approximately 10 nano-Farads (nF), where, for instance, the charge roller 510 comprises a conductive ceramic material. In such case, the resistance of resistor 594 may be approximately 1.3 kilo-ohms (within a 30 percent margin of error). In one example, the capacitance of capacitor 598 is approximately 2 nF (measured under touching condition), while the resistance of resistor 597 may be approximately 10 mega-ohms.

In one example, the capacitance of the capacitor 596 representing the gap between the charge roller 510 and PIP 555 may be determined in accordance with Equations 1 and 2:

$$I_{AC}=V_{AC}/Z_{AC}=i\omega C\cdot V_{AC}=i\omega\cdot C(d)\cdot V_{AC} \quad \text{—Equation 1}$$

$$C(d)=(I_{AC}/V_{AC})/i\omega \quad \text{—Equation 2}$$

In Equations 1 and 2, $I_{AC}$, $V_{AC}$, and $Z_{AC}$ are the current, voltage, and impedance respectively, in an alternating current environment, w is an angular velocity of the circuit, equal to $2\pi\cdot f$, where f is frequency, and C is the capacitance of the capacitor, where $1/(i\omega C)$ is the complex impedance of the capacitor, and where C(d) is the capacitance at a particular separation distance. Given the above parameters for the components of the circuit 500, the measured capacitance of the tunable capacitor 596 may vary from 100 pF to 1500 pF within the range of separation distances between the charge roller 510 and the PIP 550 achievable in an example printing device.

In one example, a charge roller voltage 523 may be assumed to be the same as, or close to the output voltage 521. For instance, insofar as there is no direct current (DC) in the circuit 500 due to the air gap modeled by capacitor 596, the resistors may effectively be ignored. Thus, charge roller voltage 523 may be equivalent or substantially equivalent to output voltage 521, and may be assumed to be a known variable, e.g., $V_{AC}$. In one example, the AC current i1, 524, may be utilized as $I_{AC}$ in Equations 1 and 2. In one example, current measuring unit 525 measures an AC current i2, 526, from which AC current i1, 524, may be determined, given the known values in the circuit 500. In one example, the current measuring unit 525 may comprise a coil transformer, a rectifier, and an integrator. For instance, current measuring unit 525 may include a Rogowski coil, or similar device, which may output a voltage that is proportional to a change in current. By passing the voltage that is output by the coil transformer to the integrator via the rectifier, a voltage that is representative of the current i2, 526 may be obtained. In one example, the out-of-phase components are derived. Thus, in one example, the current measuring unit 525 provides phase sensitive detection (lock-in) of the current to charge roller 510.

Current measuring device 525 is illustrated in FIG. 5 as measuring AC current 526, i2, near the output of power supply 527. However, in other examples, current measuring device 525 may measure an AC current elsewhere in the circuit, from which AC current 524, i1, may then be calculated. As mentioned above, charge roller voltage 523 may be assumed to be the same as, or close to the output voltage 521. However, in one example, charge roller voltage 523, or a voltage elsewhere in the circuit 500, may be separately measured for purposes of determining the charge roller voltage 523.

Since $V_{AC}$ is a known parameter and since $I_{AC}$ may be measured, the capacitance C(d) of the capacitor 596 representing the charge roller 510 to PIP 555 gap may be determined once $I_{AC}$ is measured. However, in some examples, the capacitance of capacitor 596 representing the gap between the charge roller 510 and PIP 550 is not calculated. For instance, since the calibration position may be determined based upon a derivative, the rate of change of the capacitance may be of greatest interest rather than the actual magnitude of the capacitance. In addition, since the rate of change of the capacitance is greatest at the same index position the rate of change of the measured alternating current is greatest, the calibration position can be determined directly from a derivative or rate of change of the alternating current measures, without calculating the actual capacitance values.

In one example, the capacitance between a charge roller and PIP may be modeled upon a cylinder over an infinite plane. For instance, the charge roller 510 may have a significantly smaller radius than the PIP 555 (as well as the PIP member supporting the PIP 555), such that the PIP 555 may be represented as an infinite plane and the charge roller 510 represented as a cylinder. In such an approximation, the capacitance may be given by Equation 3:

$$C=(2\pi\cdot e_0\cdot L)/(\cos h^{-1}(1+g/R)) \quad \text{—Equation 3}$$

In Equation 3, "C" is the capacitance, "L" is the length of the cylinder, "g" is the gap or separation distance between the surface of the cylinder and the plane, "R" is the radius of the cylinder, and "$e_0$" is the permittivity of free space. The capacitance is inversely dependent upon the separation distance. Utilizing Equation 3, the distance d may be calculated when the capacitance is determined based upon the AC current measurement and the known voltage according to Equation 2. For example, Equation 3 may be utilized in verifying an operating position of charge roller 510 (e.g., a float position of a permanent charge roller, a jump position for a contact charge roller, and so forth), where the charge roller 510 has already been leveled and placed into operation. Where the distance, d, is outside a target distance window, an operating position of the charge roller may be adjusted back to a desired operating position.

Figure 6:
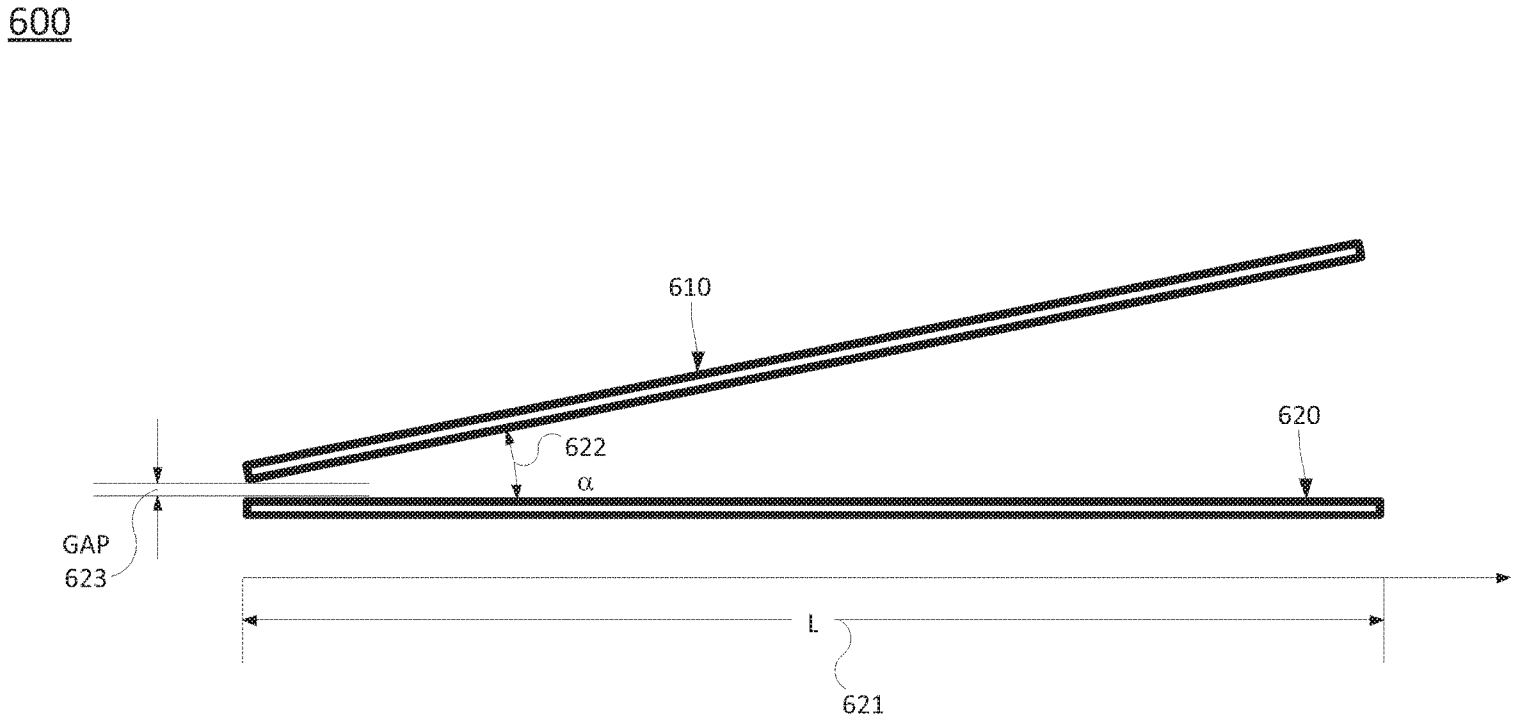
FIG. 6 is a representation of two inclined slabs, which may be used as a model of an example system of the present disclosure.

In reference to FIG. 6, in another example, the capacitance between a charge roller and PIP may be modeled upon two slabs at an angle. The system 600 of FIG. 6 includes a first slab 610 and a second slab 620. In one example, "L" is the length 621 of the slabs 610 and 620, "α" is the angle 622 between the slabs, "w" is the width of the slabs, "$e_r$" is the relative permittivity, and "g" is the separation distance or gap 623 between the closest edges of the slabs. The capacitance of such an arrangement may be represented by Equation 4:

$$C=[(e_r\cdot w)/(4\pi\cdot\sin\alpha)]\cdot\ln[(\tan\alpha\cdot L)/g+1] \quad \text{—Equation 4}$$

In one example, it may be assumed that L/g is 1000 or greater. In other words, the gap is small compared to the slab length. In such case, the capacitance is inverse log proportional to the angle α. Equation 4 is undefined at angle α equal to zero, and the model does not hold under such conditions. At the detachment point between two slabs, where the angle α is closest to zero, capacitance is finite. However, the magnitude of the derivative of the capacitance is greatest at a very small angle α. For example, at zero a, the capacitance may approach the value represented by Equation 3.

It should be noted that even though one end of the charge roller may be resting on the PIP, the "gap" distance may be non-zero. For instance, the PIP may comprise a photoconductor layer, a conductor layer, and an insulator. The photoconductor layer may also act as an insulator in the absence of an irradiating light source. Thus, the photoconductor layer may provide a small, insulating gap between the charge roller and the conductor layer. It should also be noted that Equations 3 and 4 represent models with two different geometries, and are presented by way of example. Nevertheless, the principle that the magnitude of the derivative of the capacitance is greatest at a very small angle α (e.g., the smallest achievable angle greater than zero) holds true regardless of whether the charge roller and PIP are modeled as two unequally sized cylinders, two slabs, a cylinder over an infinite plane, and so forth. In addition, it should be noted that various additional models and approximations of the capacitance between the charge roller and PIP may be used as alternatives, or in addition to the example Equations 3 and 4.

In view of the proportionality between the capacitance and the AC current, the present disclosure may involve measuring the AC current multiple times while raising and/or lowering one end of the charge roller as a function of index position, and determining that the index position at or near which the greatest change in capacitance (or current) versus index position is measured is the position where the charge roller and PIP are just separated. The process may be repeated for the other end of the charger roller. In one example, the calibration position comprises the pair of index positions for the respective ends of the charge roller, where the end of the charge roller just separates from the surface of the PIP. For instance, the index position at which separation between the charge roller and PIP occurs for one end of the charge roller may be different from the index position at which separation between the charge roller and PIP occurs for the other end of the charge roller. In one example, a single shift (a change between consecutive index positions) may correspond to approximately 17 micrometers (um). Thus, due to small surface variations in the PIP, surface variations in the charge roller, alignment issues with positioning units for the charge roller, thermal expansion of the PIP member, and so forth, the respective index positions of the calibration position for each the two ends of the charge roller may be different by one or more index positions.

Figure 7:
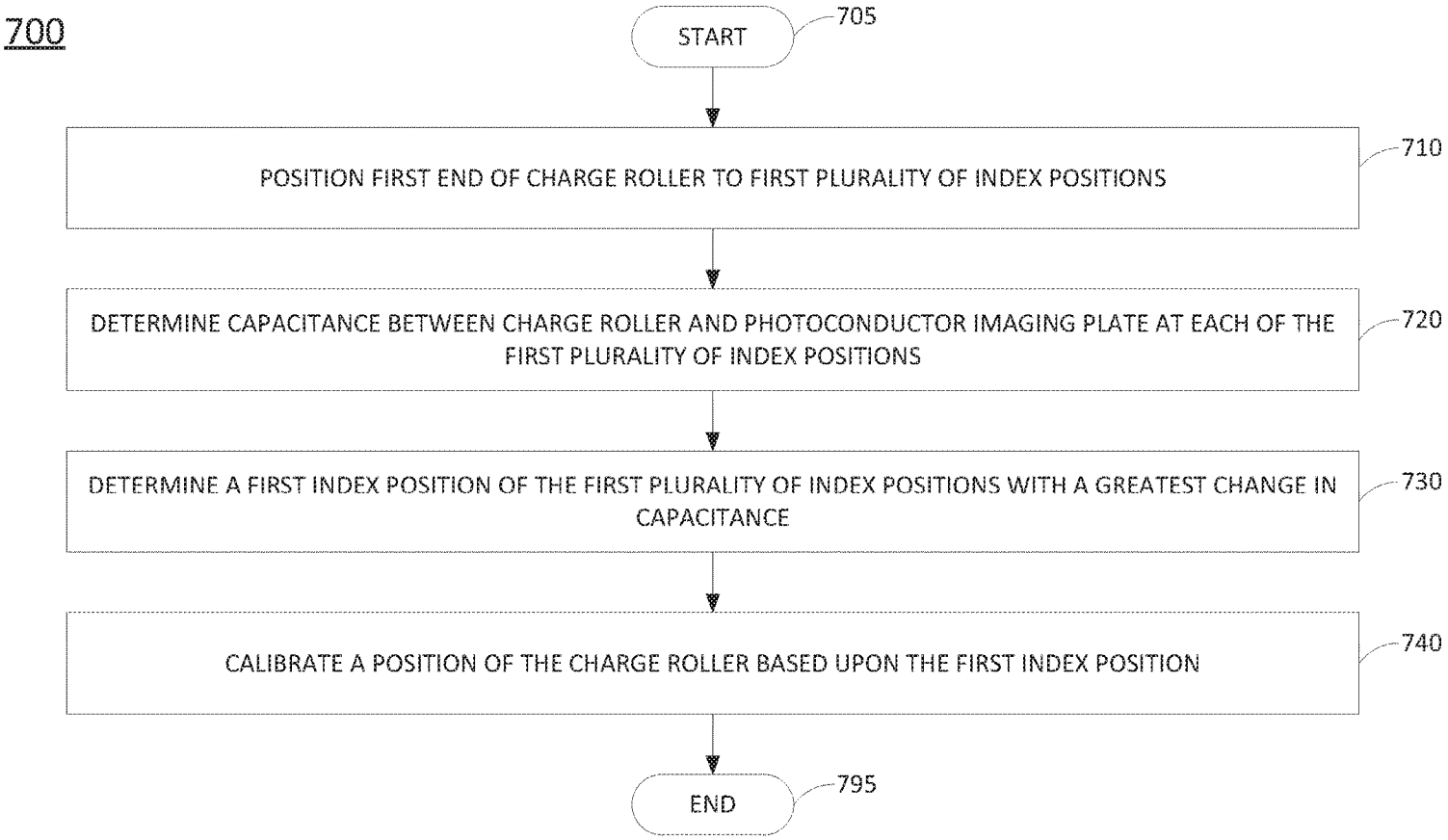
FIG. 7 illustrates a flowchart of an example method for calibrating a position of a charge roller.

FIG. 7 illustrates a flowchart of an example method 700 for calibrating a position of a charge roller. The method 700 may be performed, for example, by any one or more of the components of the system 400 illustrated in FIG. 4. For example, the method 700 may be performed by controller 420 and/or controller 420 in conjunction with power supply 427, current measuring unit 425, positioning units 432 and 434, and so forth. However, the method 700 is not limited to implementation with the system illustrated in FIG. 4, but may be applied in connection with any number of photolithographic printing devices having a charge roller and a photoconductor imaging plate (PIP). Alternatively, or in addition, one or more blocks of the method 700 may be implemented by a computing device having a processor, a memory, and input/output devices as illustrated below in FIG. 10, specifically programmed to perform the blocks of the method. Although any one of the elements in system 400, or in a similar system, may be configured to perform various blocks of the method 700, the method will now be described in terms of an example where blocks of the method are performed by a processor, such as processor 1002 in FIG. 10.

The method 700 begins in block 705. In block 710, the processor positions a first end of a charge roller to a first plurality of index positions. For instance, the charge roller may comprise a component of a printing device that further includes at least one positioning unit and a photoconductor imaging plate (PIP). In one example, the charge roller may comprise a conductive ceramic material. In another example, the charge roller may comprise a conductive rubber material. In one example, a respective positioning unit is coupled to each end of the charge roller for raising and lowering each of the ends of the charge roller in relation to the PIP. In one example, the PIP may comprise a component of, and be supported by, a PIP member, such as a drum or cylinder. In one example, the index positions comprise discrete increments. For example, the at least one positioning unit may be configured to change the position of an end of the charge roller in an incremental manner. In one example, the processor may send instructions to the at least one positioning unit to cause the at least one positioning unit to move the first end of the charge roller to a particular index position, or to move the first end of the charge roller through a sequence of index positions. In one example, block 710 comprises moving the first end of the charge roller through all or portion of the possible index positions. In one example, the charge roller may first be placed in contact with the PIP and then raised through the first plurality of index positions. However, in another example, the charge roller may be first raised and then lowered through the first plurality of index positions until a last index position is reached, or until the charge roller comes into contact with the PIP and cannot be lowered any further.

In block 720, the processor measures an alternating (AC) current in a circuit comprising the charge roller and the PIP when the charge roller is positioned at each of the first plurality of index positions. In one example, the processor measures the AC current via a current measuring unit of the printing device. In one example, the current measuring unit measures an AC current near the output of a voltage source of the printing device. In one example, the current measuring unit comprises a coil transformer, a rectifier, and an integrator. In one example, the current measuring unit may output a voltage that is representative of the measured AC current. In one example, the AC current is proportional to a capacitance between the charge roller and the PIP.

In block 730, the processor determines a first index position of the first plurality of index positions with a greatest change in capacitance. For instance, the derivative of the capacitance between the charge roller and the PIP versus index position may be used to determine the first index position of the first plurality of index positions with a greatest change in capacitance. In one example, the capacitance at each of the index positions is calculated using a formula based upon the measured AC current and a known voltage, e.g., output by a voltage source of the printing device. In one example, a maximum of the derivative, where there is the greatest rate of change in the capacitance versus index position, is determined to be an index position at which the charge roller is just separated from the PIP drum. Thus, in one example, block 730 may include calculating a change in capacitance for each of the first plurality of index positions based upon the capacitance that is calculated between the charge roller and the PIP for each of the first plurality of index positions.

In one example, the measured AC current values, or the voltages output by the current measuring unit that are representative of the AC current values, may be used as representative of the capacitance. For example, the index position exhibiting the greatest change in capacitance versus index position will also be the index position having a maximum of the derivate of the AC current versus index position (and maximum of the derivative of the voltage representing the AC current versus index position).

In one example, the maximum may be indicated between two index positions. Thus, the greater or lesser of the two index positions may be selected as the first index position. In one example, the greater of the two index positions is selected, since the greater index position may be assumed to be a position where the first end of the charge roller is not in contact with the PIP, whereas the lesser index position may be assumed to be a position where the first end of the charge roller remains in contact with the PIP. In addition, the first index position may be one of two index positions that comprise a calibration position of the charge roller. For instance, the other index position may comprise a second point for the other end of the charge roller at which the charge roller is just separated from the PIP.

In block 740, the processor calibrates a position of the charge roller based upon at least the first index position. In one example, the calibrating comprises placing the charge roller in an operating position. For example, the calibrating may comprise setting the first end of the charge roller to a first operating index position, based upon a first offset from the first index position. In one example, the calibrating may further comprise setting the second end of the charge roller to a second operating index position, based upon a second offset from the second index position. For instance, a single shift (a change from one index position to a next index position) may correspond to a change in distance between the charge roller and the PIP of 17 microns. In addition, in one example an operating position of a ceramic charge roller may be a position where each end of the charge roller is three index positions, or 51 microns above the PIP drum. Thus, the first index position (and the second index position) may indicate that an end of the charge roller is 17 microns above the PIP. Accordingly, a first offset may comprise a shift of two index positions away from the PIP, placing the first end of the charge roller at approximately 51 microns above the PIP. A similar offset may be implemented with respect to the second end of the charge roller.

In another example, the charge roller may comprise a contact charge roller. In this case, a desired operating position for non-seam areas of the PIP may comprise both ends of the charge roller at index positions where the charge roller is just touching the PIP. Thus, the first offset may comprise a shift of one index position toward the PIP. A similar offset may be implemented with respect to the second end of the charge roller. In one example, at block 740 the processor may alternatively or additionally calibrate a jump position of the charge roller based upon the first and/or the second index positions of the calibration position. For instance, in a seam area of the PIP member, the charge roller may be raised by the positioning units to a jump position, such that the charge roller is not in contact with the PIP. The charge roller may be lowered back into contact with the PIP when the seam area has passed. Thus, in one example, the jump position may comprise a pair of index positions that are determined based upon an offset of a number of index positions from the calibration position (or based upon an offset from the operating position for non-seam areas of the PIP).

Following block 740, the method 700 proceeds to block 795 where the method ends.

Figure 8:
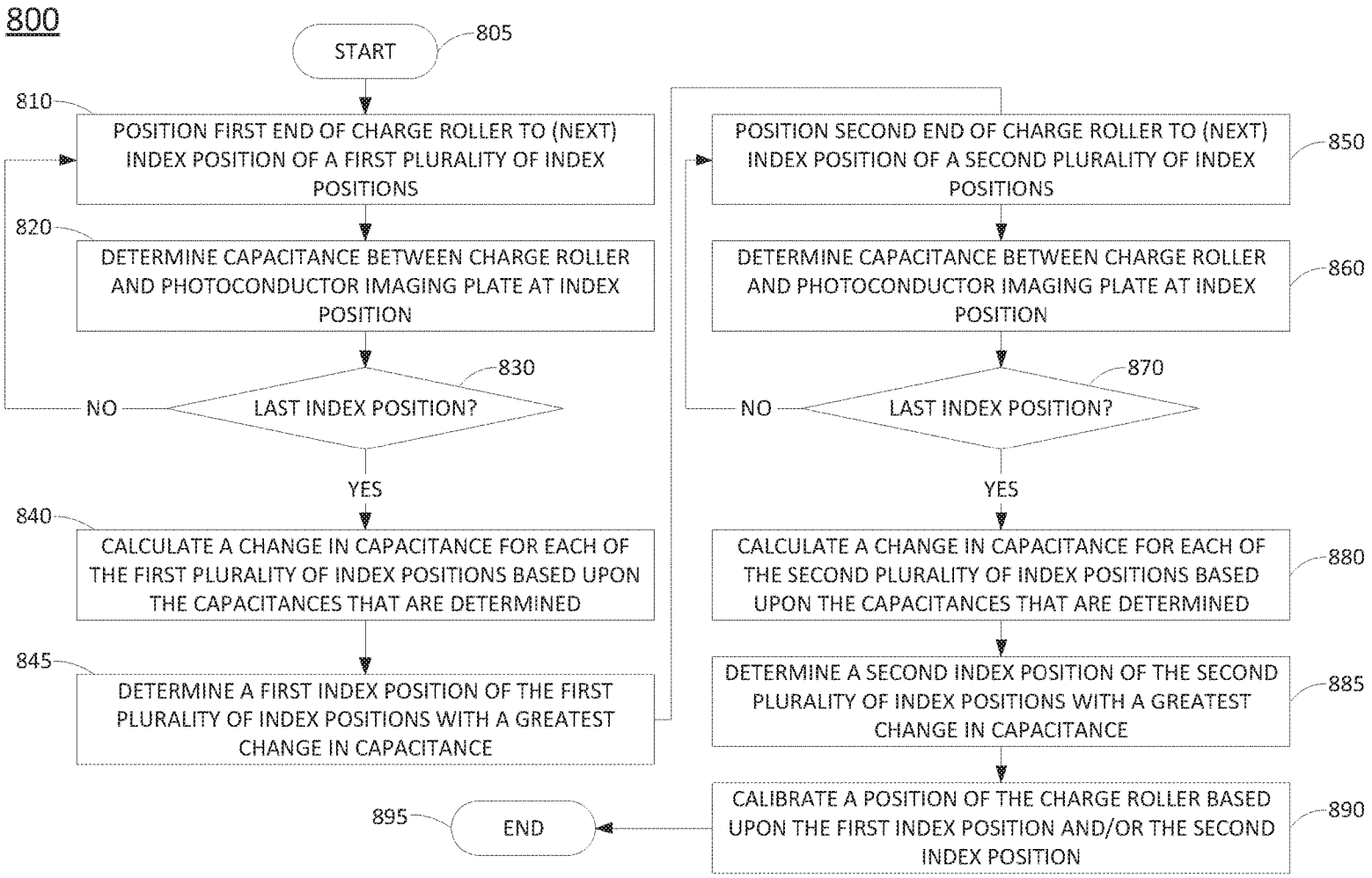
FIG. 8 illustrates a flowchart of an additional example method for calibrating a position of a charge roller.

FIG. 8 illustrates a flowchart of an additional example method 800 for calibrating a position of a charge roller. The method 800 may be performed, for example, by any one or more of the components of the system 400 illustrated in FIG. 4. For example, the method 800 may be performed by controller 420 and/or controller 420 in conjunction with power supply 427, current measuring unit 425, positioning units 432 and 434, and so forth. However, the method 800 is not limited to implementation with the system illustrated in FIG. 4, but may be applied in connection with any number of photolithographic printing devices having a charge roller and a photoconductor imaging plate (PIP). Alternatively, or in addition, one or more blocks of the method 800 may be implemented by a computing device having a processor, a memory, and input/output devices as illustrated below in FIG. 10, specifically programmed to perform the blocks of the method. Although any one of the elements in system 400, or in a similar system, may be configured to perform various blocks of the method 800, the method will now be described in terms of an example where blocks of the method are performed by a processor, such as processor 1002 in FIG. 10.

The method 800 begins in block 805. In block 810, the processor positions a first end of a charge roller to an index position of a first plurality of index positions. For instance, the first end of the charge roller may be positioned to a highest or lowest index position. In one example, the processor positions the first end of the charge roller via a first positioning unit.

In block 820, the processor measures an AC current in a circuit comprising the charge roller and a photoconductor imaging plate (PIP). In one example, the processor measures the AC current via a current measuring unit of the printing device.

In block 830, the processor determines whether a last index position is reached. If the last index position is reached, the method 800 proceeds to block 840. Otherwise, if the last index position has not been reached, the method 800 proceeds back to block 810 where the first end of the charge roller is positioned to a next index position, the measurement of the AC current is taken at block 820, and so on. In one example, the operations of blocks 810-830 may comprise the same or similar operations to those discussed above in connection with blocks 710 and 720 of the method 700.

In block 840, the processor calculates a change in capacitance for each of the first plurality of index positions based upon the AC current that is measured between the charge roller and the PIP at each of the first plurality of index positions. In one example, the capacitance between the charge roller and the PIP for each index position is calculated from the measured AC current, and the change in capacitance versus index position is derived from the set of capacitances that are calculated. However, in another example, the measured AC current, or a voltage of a current measuring unit that corresponds to the AC current, may be used as representative of the capacitance. In such an example, the change in capacitance may be represented by a change in the AC current, or a change in voltage output by a current measuring unit versus index position.

In block 845, the processor determines a first index position of the first plurality of index positions with a greatest change in capacitance. For instance, the change in capacitance for each of the first plurality of index positions calculated at block 840 may be used to find a maximum of the derivative. The maximum may indicate the index position where there is the greatest rate of change in the capacitance. In one example, this is determined to be the first index position, the point at which the first end of the charge roller is just separated from the PIP. As mentioned above, in one example the measured AC current values or the voltage representing the AC current values may be used as representative of the capacitance. Thus, in one example, at block 845, the derivative of the measured AC current values versus index position may be used to determine the first index position of the first plurality of index positions with a greatest change in AC current values, and hence the greatest change in capacitance. In one example, the operations of blocks 840 and 845 may comprise the same or similar operations to those discussed above in connection with block 730 of the method 700.

In block 850, the processor positions a second end of a charge roller to an index position of a second plurality of index positions. For instance, the second end of the charge roller may be positioned to a highest or lowest index position. In one example, the processor positions the second end of the charge roller via a second positioning unit.

In block 860, the processor measures an AC current in a circuit comprising the charge roller and the PIP. In one example, the processor measures the AC current via a current measuring unit of the printing device.

In block 870, the processor determines whether a last index position is reached. If the last index position is reached, the method 800 proceeds to block 880. Otherwise, if the last index position has not been reached, the method 800 proceeds back to block 850 where the second end of the charge roller is positioned to a next index position, the measurement of the AC current is taken at block 860, and so on. In one example, the operations of blocks 850-870 may comprise similar operations to those discussed above in connection with blocks 810-830, or in connection with blocks 710 and 720 of the method 700.

In block 880, the processor calculates a change in capacitance (e.g., the actual capacitance, or an AC current or voltage that is representative of the capacitance) for each of the second plurality of index positions based upon the AC current that is measured for each of the second plurality of index positions.

In block 885, the processor determines a second index position of the second plurality of index positions with a greatest change in capacitance versus index position. In one example, the operations of blocks 880 and 885 may comprise similar operations to those discussed above in connection with blocks 840 and 845, or in connection with block 730 of the method 700.

In block 890, the processor calibrates a position of the charge roller based upon at least the first index position. In one example, the calibrating comprises placing the charge roller in an operating position. For example, the calibrating may comprise setting the first end of the charge roller to a first operating index position, based upon a first offset from the first index position. In one example, the calibrating may further comprise setting the second end of the charge roller to a second operating index position, based upon a second offset from the second index position. In one example, at block 890 the processor may alternatively or additionally calibrate a jump position of the charge roller based upon the first and/or the second index positions of the calibration position. In one example, the operations of block 890 may comprise the same or similar operations to those discussed above in connection with block 740 of the method 700.

Following block 890, the method 800 proceeds to block 895 where the method ends.

Figure 9:
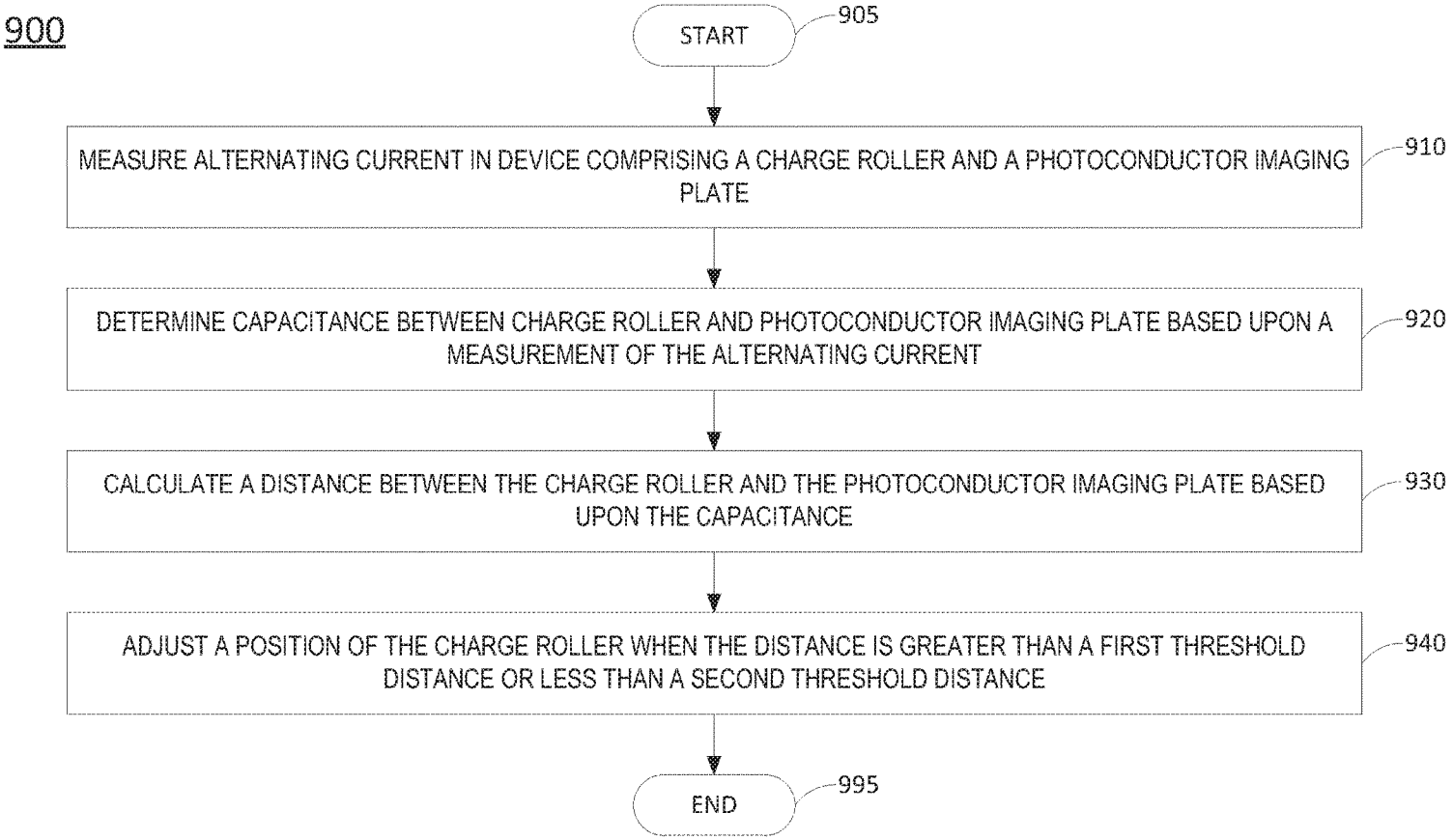
FIG. 9 illustrates a flowchart of an example method for adjusting a position of a charge roller.

FIG. 9 illustrates a flowchart of an example method 900 for adjusting a position of a charge roller. The method 900 may be performed, for example, by any one or more of the components of the system 400 illustrated in FIG. 4. For example, the method 900 may be performed by controller 420 and/or controller 420 in conjunction with power supply 427, current measuring unit 425, positioning units 432 and 434, and so forth. However, the method 900 is not limited to implementation with the system illustrated in FIG. 4, but may be applied in connection with any number of photolithographic printing devices having a charge roller and a photoconductor imaging plate (PIP). Alternatively, or in addition, one or more blocks of the method 900 may be implemented by a computing device having a processor, a memory, and input/output devices as illustrated below in FIG. 10, specifically programmed to perform the blocks of the method. Although any one of the elements in system 400, or in a similar system, may be configured to perform various blocks of the method 900, the method will now be described in terms of an example where blocks of the method are performed by a processor, such as processor 1002 in FIG. 10.

The method 900 begins in block 905. In block 910, the processor measures an alternating current in a device comprising a charge roller and a photoconductor imaging plate. For example, the device may comprise a printing device, e.g., for photolithographic printing. In one example, the AC current is measured in a circuit comprising the charge roller and the photoconductor imaging plate. In one example, the AC current is measured via a current measuring unit of the printing device. In one example, the current measuring unit measures the AC current near the output of a voltage source of the printing device. In one example, the current measuring unit comprises a coil transformer, a rectifier, and an integrator. In one example, the current measuring unit may output a voltage that is representative of the measured AC current.

In block 920, the processor determines a capacitance between the charge roller and the PIP based upon a measurement of the AC current. For instance, in one example the AC current is proportional to a capacitance between the charge roller and the PIP. In one example, the capacitance may be determined in accordance with Equation 2, mentioned above. For instance, given a known voltage output by a voltage source and the measured AC current, the capacitance may be determined.

In block 930, the processor calculates a distance between the charge roller and the PIP based upon the capacitance. For instance, the charge roller and the PIP may be modeled as a capacitor. In one example, the capacitor may be modeled as a cylinder over an infinite plane, representing the charge roller and the PIP respectively. In one example, the model may take the form of Equation 3 given above. Given the capacitance determined at block 920, the separation distance between the charge roller and the PIP may then be determined.

In block 940, the processor adjusts a position of the charge roller when the distance is greater than a first threshold distance or less than a second threshold distance. For example, a target operating window may comprise a maximum gap and a minimum gap (e.g., a first threshold distance and a second threshold distance) that results in good print quality. However, during operations a floating position for a permanent charge roller or a jump position for a contact charge roller may drift from a target separation distance due to various factors. Thus, the method 900 may relate to monitoring the separation distance and correcting the separation distance when the separation distance falls outside a target distance window comprising the first threshold and the second threshold distances. To illustrate, a jump position of the charge roller may comprise a shift of four index positions from an operating position for non-seam areas of the PIP. In one example, a shift between consecutive index positions may correspond to a 17 micron change in position. Thus, the four index position shift may correspond to a 68 micron jump. In addition, each end of the charge roller may be shifted by the same number of index positions to reach the jump position. In one example, the target distance window for the jump position may be from 40 microns to 80 microns. However, the processor performing blocks 910-930 may determine that the measured separation distance is 30 microns, and hence outside the target window. Thus, at block 940, the processor may determine that the jump position should be one or more additional index positions offset from the operating position for the non-seam areas of the PIP. For instance, one or two more index positions corresponding to 17 or 34 microns would place the charge roller back within the target window for the jump position. In one example, the processor causes the position of the charge roller to be adjusted via one or more positioning units, e.g., at respective ends of the charge roller.

Following block 940, the method 900 proceeds to block 995 where the method ends.

It should be noted that although not explicitly specified, one or more blocks, functions, or operations of the methods 700, 800, and 900 described above may include storing, displaying, and/or outputting. In other words, any data, records, fields, and/or intermediate results discussed in the methods can be stored, displayed, and/or outputted to another device depending on the particular application. Furthermore, blocks, functions, or operations in FIGS. 7-9 that recite a determining operation, or involve a decision, do not necessarily imply that both branches of the determining operation are practiced. In other words, one of the branches of the determining operation can be deemed as optional.

FIG. 10 depicts a high-level block diagram of a computing device suitable for use in performing the functions described herein. As depicted in FIG. 10, the computer 1000 comprises a hardware processor element 902, e.g., a central processing unit (CPU), a microprocessor, or a multi-core processor, a memory 1004, e.g., random access memory (RAM), a module 1005 for calibrating or adjusting a position of a charge roller, and various input/output devices 1006, e.g., storage devices, including but not limited to, a tape drive, a floppy drive, a hard disk drive or a compact disk drive, a receiver, a transmitter, a speaker, a display, a speech synthesizer, an output port, an input port and a user input device, such as a keyboard, a keypad, a mouse, a microphone, and the like. Although one processor element is shown, it should be noted that the general-purpose computer may employ a plurality of processor elements. Furthermore, although one general-purpose computer is shown in the figure, if the method(s) as discussed above is implemented in a distributed or parallel manner for a particular illustrative example, i.e., the blocks of the above method(s) or the entire method(s) are implemented across multiple or parallel general-purpose computers, then the general-purpose computer of this figure is intended to represent each of those multiple general-purpose computers.

It should be noted that the present disclosure can be implemented by machine readable instructions and/or in a combination of machine readable instructions and hardware, e.g., using application specific integrated circuits (ASIC), a programmable logic array (PLA), including a field-programmable gate array (FPGA), or a state machine deployed on a hardware device, a general purpose computer or any other hardware equivalents, e.g., computer readable instructions pertaining to the method(s) discussed above can be used to configure a hardware processor to perform the blocks, functions and/or operations of the above disclosed methods.

In one example, instructions and data for the present module or process 1005 for calibrating or adjusting a position of a charge roller, e.g., machine readable instructions can be loaded into memory 1004 and executed by hardware processor element 1002 to implement the blocks, functions, or operations as discussed above in connection with the example methods 700, 800, and 900. Furthermore, when a hardware processor executes instructions to perform "operations", this could include the hardware processor performing the operations directly and/or facilitating, directing, or cooperating with another hardware device or component, e.g., a co-processor and the like, to perform the operations.

The processor executing the machine readable instructions relating to the above described method(s) can be perceived as a programmed processor or a specialized processor. As such, the present module 1005 for calibrating or adjusting a position of a charge roller, including associated data structures, of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. Furthermore, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, or variations therein may be subsequently made, which are also intended to be encompassed by the following claims.

What is claimed is:

1. A method comprising:

positioning a first end of a charge roller to a first plurality of index positions;

determining a capacitance between the charge roller and a photoconductor imaging plate at each of the first plurality of index positions;

calculating a change in capacitance for each of the first plurality of index positions based upon the capacitances that are determined; and calibrating a position of the charge roller based upon the calculated change in capacitance for each of the first plurality of index positions.

2. The method of claim 1, wherein the capacitance is determined based upon a measurement of an alternating current in a circuit comprising the charge roller and the photoconductor imaging plate.

3. The method of claim 2, wherein the alternating current is measured by:

measuring a voltage in a circuit comprising the charge roller and the photoconductor imaging plate via a coil transformer; and applying the voltage to an integrator through a rectifier.

4. The method of claim 1, wherein the positioning comprises:

positioning the charge roller in contact with the photoconductor imaging plate; and raising the first end of the charge roller through the first plurality of index positions.

5. The method of claim 1, further comprising:

calculating a change in capacitance for each of the first plurality of index positions based upon the capacitance that is measured between the charge roller and the photoconductor imaging plate at each of the first plurality of index positions.

6. The method of claim 1, wherein the calibrating the position of the charge roller comprises:

setting the first end of the charge roller to an operating position, based upon an offset from a first index position.

7. The method of claim 1, further comprising:

raising a second end of the charge roller to a second plurality of index positions;

measuring a capacitance between the charge roller and the photoconductor imaging plate at each of the plurality of second index positions; and calculating a change in capacitance for each of the second plurality of index positions based upon the measured capacitances at each of the plurality of second index positions.

8. The method of claim 7, wherein the calibrating the position of the charge roller is further based upon a second index position.

9. The method of claim 8, wherein the calibrating the position of the charge roller comprises:

setting the first end of the charge roller to a first operating index position, based upon a first offset from the first index position; and setting the second end of the charge roller to a second operating index position, based upon a second offset from the second index position.

10. The method of claim 7, further comprising determining a second index position of the plurality of index positions with a greatest change in capacitance.

11. The method of claim 1, further comprising determining a first index position of the first plurality of index positions with a greatest change in capacitance.

12. The method of claim 11, wherein the first index position is used to calibrate the position of the charge roller.

13. A method for adjusting a position of a charge roller comprising:

measuring an alternating current in a printing device, wherein the printing device comprises a charge roller and a photoconductor imaging plate;

determining a capacitance between the charge roller and the photoconductor imaging plate, wherein the capacitance is determined based upon a measurement of the alternating current;

calculating a distance between the charge roller and the photoconductor imaging plate based upon the capacitance; and adjusting a position of the charge roller based upon the distance that is calculated.

14. The method of claim 13, wherein the measuring the alternating current is performed by:

measuring a voltage in a circuit comprising the charge roller and the photoconductor imaging plate via a coil transformer; and applying the voltage to an integrator through a rectifier.

15. The method of claim 13, wherein determining the capacitance is in accordance with: $C=I/(\omega V)$, where I is an alternating current, V is a voltage, and $\omega$ is an angular velocity, and wherein the distance is calculated in accordance with: $C=(2\pi \cdot e_0 \cdot L)/(\cos h^{-1}(1+g/R))$, where C is the capacitance, L is a length of the charge roller, g is a separation distance between the charge roller and the photoconductor imaging plate, R is a radius of the charge roller, and $e_0$ is a permittivity of free space.

16. The method of claim 13, wherein determining the capacitance is further based upon a voltage of a power supply.

17. A device comprising:

a charge roller;

a photoconductor imaging plate;

at least one positioning unit for positioning at least a first end of the charge roller to a first plurality of index positions;

a current sensor, for measuring an alternating current in a circuit comprising the charge roller and the photoconductor imaging plate when the at least the first end of the charge roller is at each of the first plurality of index positions, wherein the alternating current is proportional to a capacitance between the charge roller and the photoconductor imaging plate; and a controller to:

calculate a change in capacitance for each of the first plurality of index positions based upon the measurement of the alternating current; and calibrating a position of the charge roller based upon the change in capacitance for each of the first plurality of index positions.

18. The device of claim 17, wherein the controller is further for:

sending instructions to the at least one positioning unit to position the at least the first end of the charge roller to the first plurality of index positions; and sending instructions to the current sensor to measure the alternating current when the at least the first end of the charge roller is at each of the first plurality of index positions.

19. The device of claim 17, wherein the controller is further to determine a first index position of the first plurality of index positions with a greatest change in capacitance.

20. The device of claim 19, wherein the first index position is used to calibrate the position of the charge roller.

* * * * *